United States Patent [19]

Osborne

[11] Patent Number: 4,531,669

[45] Date of Patent: Jul. 30, 1985

[54] INTERLOCK BETWEEN TELESCOPING COVER AND TRAY

[75] Inventor: Edward L. Osborne, Kansas City, Kans.

[73] Assignee: Westvaco Corporation, New York, N.Y.

[21] Appl. No.: 511,100

[22] Filed: Jul. 6, 1983

[51] Int. Cl.[3] ..... B65D 5/54

[52] U.S. Cl. ..... 229/45 R; 229/23 BT; 229/31 R; 206/604; 206/607

[58] Field of Search ..... 229/23 R, 23 BT, 31 R, 229/34 A, 32, 35, 41 R, 41 B, 45 R, 43, 33, 36; 206/604, 607, 620, 634

[56] References Cited

U.S. PATENT DOCUMENTS

| | | | |
|---|---|---|---|
| 1,130,271 | 3/1915 | Hammond | 229/45 R |
| 2,021,980 | 11/1935 | Bachmeyer | 229/41 B X |
| 2,073,272 | 3/1937 | Wellman | 229/23 R X |
| 2,171,051 | 8/1939 | Stonecypher | 229/41 B X |
| 2,369,385 | 2/1945 | Carruth et al. | 229/41 B |
| 2,545,802 | 3/1951 | Bergstein | 229/45 R X |
| 2,713,963 | 7/1955 | Andrews et al. | 229/45 R X |
| 2,800,266 | 7/1957 | Kelly | 229/37 |
| 3,115,292 | 12/1963 | Repking | 229/45 R |
| 3,116,007 | 12/1963 | D'Esposito et al. | 229/45 R |
| 3,247,955 | 4/1966 | Buck | 206/46 |
| 4,114,798 | 9/1978 | Gardner | 229/32 X |
| 4,469,273 | 9/1984 | Smith | 229/23 BT |

FOREIGN PATENT DOCUMENTS

| | | | |
|---|---|---|---|
| 454022 | 1/1949 | Canada | 229/33 |
| 728997 | 3/1966 | Canada | 229/45 R |

*Primary Examiner*—William Price
*Assistant Examiner*—Gary E. Elkins

[57] ABSTRACT

A self locking container is provided of the telescoping tray and cover type wherein the components are normally collapsed for storage but which may be squared for filling, closing and shipment. The locking elements comprise an outfolded locking flange on the tray component and a combination glue flap/locking flap arrangement infolded on the cover component. The container may also include a convenient removable tab element for releasing the locked components for opening the container and corner tab elements for retaining the normally collapsed side walls of the tray component in an upright condition for filling and closing.

1 Claim, 12 Drawing Figures

INTERLOCK BETWEEN TELESCOPING COVER AND TRAY

BACKGROUND OF INVENTION

The present invention relates to self locking paperboard containers of the telescoping tray and cover type. Such containers are well known in the art and are used extensively for packaging products for shipment and storage.

Various approaches have been taken by those skilled in the art to design and produce self locking containers as disclosed herein. However, in most instances, the containers have required a considerable amount of paperboard with extra panels, flaps and tabs to achieve the desired self locking feature.

As examples, U.S. Pat. No. 3,247,955 illustrates an interlocking package which requires the use of two interlocking members which are telescoped within an outer surrounding wrapper. U.S. Pat. No. 2,800,266 shows a container body with outwardly folded locking flanges on the upper edges of the side walls which become engaged with matching inwardly folded locking flanges on the lower edges of the sides of a cooperating end cap. The locking flanges in each case are extra flaps which have no purpose other than to lock the cap on one end of the container body. U.S. Pat. No. 3,115,292 illustrates a multi-wall bulk pack consisting of an outer shell with locking flaps foldably attached to and folded outwardly of the lower edges thereof. When the cap is wedged between the outer shell and inner liner the locking flaps on the shell and cap become engaged to lock the components together. However, as in the case of the aforementioned patent, the locking flaps on the cap and shell are non-functional except for their locking action. Meanwhile, in U.S. Pat. No. 4,114,798, extra tab sections are provided on the corner glue flaps for the cover element of the container which are reversely folded to engage extra flaps provided on the tray element when the two elements are telescoped together. Thus it may be seen that the prior art self locking containers are complicated in construction and use.

In contrast to the above, the self locking container of the present invention requires only a minimum amount of paperboard for its construction since it employs elements normally used in the construction of the components for performing the self locking feature. In addition, the present invention provides the self locking features applied to a collapsible, leak proof container with means for providing access to the self locking elements for effectively releasing the elements when it is desired to open the container, and means for retaining the normally collapsed walls of the container in an upright condition for use.

SUMMARY OF INVENTION

The present invention relates to self locking containers and more particularly to self locking containers consisting of telescoping tray and cover components which are normally collapsed prior to use but which may be squared, filled and closed to provide a secure package for shipment of such products as meats and poultry, or dry goods. The locking elements on at least one of the telescoping components serves at least two functions, as a locking surface and as a glue flap for forming the component. Each of the locking elements are designed for close cooperation with one another and so as to only become engaged when the cover and tray are fully telescoped one within the other.

Such containers, when closed, are normally difficult if not impossible to open. Accordingly the present invention includes a means for providing access to the locking elements in order to release them for opening the container. In addition, since the self locking features of the present invention are applied to tray and cover components which are normally collapsed when not in use, the present invention includes a provision for retaining the normally collapsed side walls of the tray component in an upright condition for filling.

The container of the present invention is preferably constructed from a foldable sheet material such as corrugated paperboard. The paperboard may be treated with appropriate water proofing treatments where required for making containers for packaging meat or poultry, or other like products. Further toward this end, the tray component is preferably formed to have a leak proof construction with gusseted corner closures for retaining juices and other liquids attendant to the packaging of meat and poultry. However, for use with dry goods or the like, the tray may be formed in a more or less conventional fashion. Meanwhile, the cover component of the container is formed in an expeditious manner using a minimum amount of material with flap elements that serve the dual functions of closing the ends of the cover and forming locking surfaces for the locking flap in the tray component.

Each of the tray and cover components are formed from separate blanks of material that are cut, scored and glued at the place of manufacture for shipment to the user in a collapsed condition. The components are carefully sized to produce a snug fit for the most effective operation of the locking function. In the preferred embodiment, each component is of about the same height and the locking function does not become effective until the components are fully telescoped one within the other.

The elements for locking the two components together comprises the joint cooperation of outwardly folded locking flaps on two opposed ends of the tray component and combination glue flaps/locking flaps folded inside and secured to the corresponding ends of the cover component. The height of the locking flaps on the tray component is precisely defined to equal the critical distance between the top of the cover component and the locking edges of the combination glue flaps/locking flaps on the cover component. In addition, the shape of the locking flaps on the tray component is defined to correspond to the shape and size of the locking edges provided on the combination glue flaps/-locking flaps. These critical dimensions provide the positive lock achieved by the container of the present invention.

Since such containers are essentially impossible to open without destroying the container, it is also a feature of the present invention to provide such containers with a readily available means for opening the container without disturbing the integrity of the leakproof tray component. Toward this end, one embodiment of the present invention includes removable tabs in the cover component that are located in the area of the locking flaps on the tray component. These removable tabs are of about the same size and shape as the tray locking flaps, and when removed, expose the locking flaps so that they may be rendered ineffective in order to open the container. This step effectively destroys the cover component but does not affect the tray component.

The present invention also includes a means for retaining the side walls of the tray in an upright condition for filling. For this purpose the end walls of the tray which include the locking flaps may be provided with inwardly folded tabs which urge the side walls outwardly when folded into position.

The container of the present invention embodies many practical advantages. Since it is shipped to the user in a flattened condition, it does not require a great deal of space for inventory. Moreover, because of the unique construction, it may be assembled and set up easily without the aid of special tools or equipment. The entire exterior surface of the fully telescoped container is free from all outward projections which conserves storage space and provides maximum printing area. The construction is also pilfer proof since access to the container is not possible without the obvious mutilation of at least the cover component.

An object of the invention is to provide a container having a body member of telescoped tray and cover components which includes an effective locking means for retaining the telescoped components in their closed condition.

Another object of the present invention is to provide a generally sift proof, pilfer proof container with an internal self locking means that may be packed, closed and shipped without additional restraining means such as straps or the like.

Still another object of the invention is to provide a self locking container which is prepared from two generally rectangular blanks of corrugated paperboard or the like in such a manner that the container components may be stored for use in a generally flattened condition.

Yet another object of the invention is to provide a simple and expedient means in a container of the class described for providing access to the locking elements in order to effectively separate the locking elements in order to open the container.

Still other objects and advantages will readily occur to those skilled in the art upon reference to the following detailed description and accompanying drawing.

DETAILED DESCRIPTION

Figure 1:
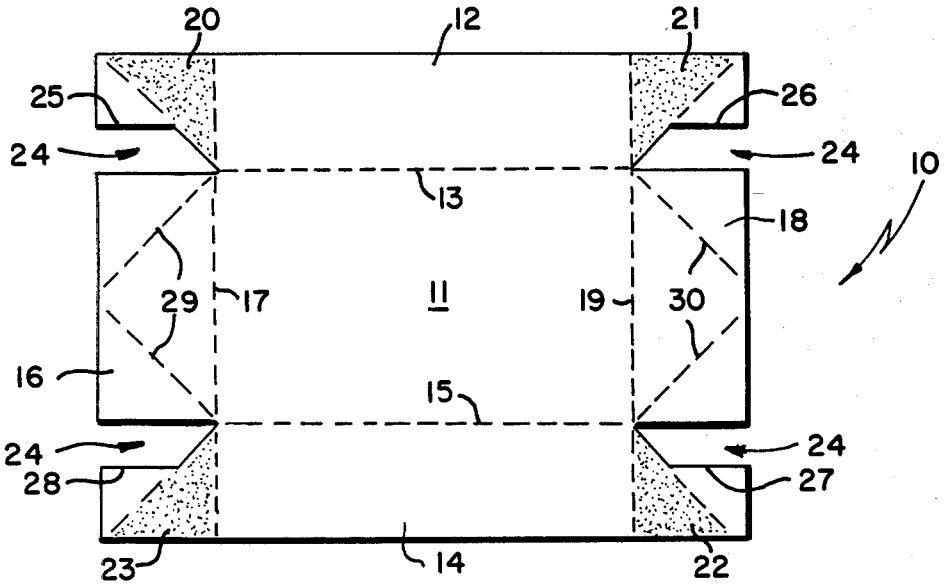
FIG. 1 is a plan view of a blank member for forming the cover component of the present invention.

Referring now in detail to FIGS. 1–7 a preferred embodiment of the invention is disclosed in both blank and finished form. FIG. 1 illustrates the blank structure 10 for the cover component of the invention which includes a substantially centrally located rectangular top panel 11 having side walls 12 and 14 foldably attached thereto along score lines 13 and 15, and end walls 16 and 18 foldably attached thereto along score lines 17 and 19. The side walls 12 and 14 further have combination glue flaps/locking flaps 20,21,22 and 23 foldably attached to the ends thereof along extensions of the score lines 17 and 19. These flaps are cut away as shown at 24 to provide locking surfaces 25,26,27 and 28. The shape and size of the cut away at 24 is designed to precisely match the shape and size of the locking flaps provided on the tray component of the container. Meanwhile, the end walls 16 and 18 of the blank are each provided with converging score lines 29 and 30 which enable the cover component to be collapsed for storage after it is formed. The areas where glue is applied to the combination glue flap/locking flaps 20,21,22 and 23 for forming the cover component is shown in FIG. 1.

Figure 3:
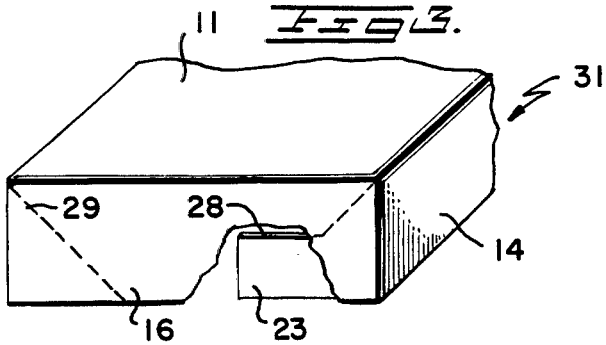
FIG. 3 is a partial perspective view with a section cut away showing one end of the formed cover component.

The cover component 31 shown as a partial section in FIG. 3 is formed by infolding and gluing the combination flaps 20 and 23 to the inside of end wall 16, and flaps 21 and 22 to the inside of end wall 18. In this condition, the cover component 31 may be collapsed by folding the end walls along the score lines 29 and 30.

Figure 2:
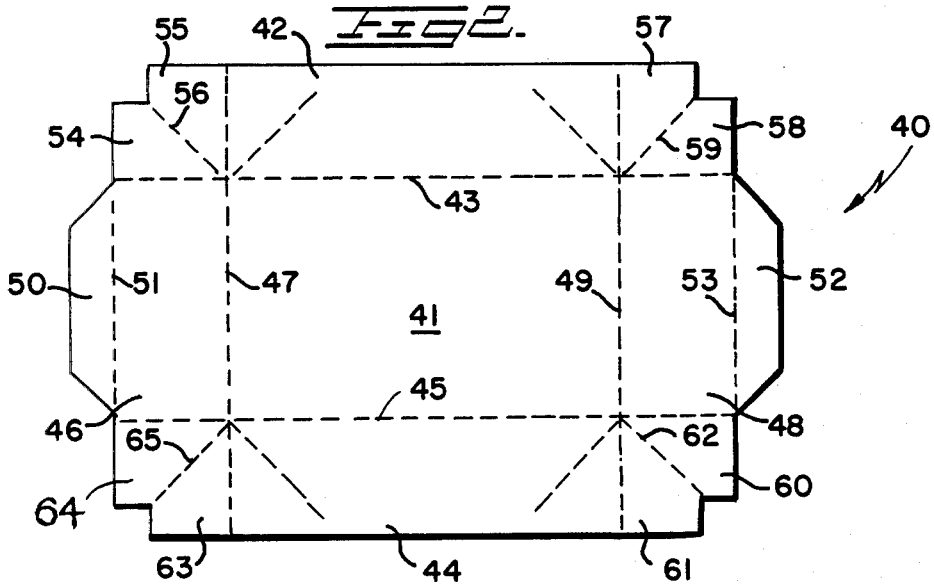
FIG. 2 is a plan view of a blank member for forming the tray component of the present invention.

FIG. 2 illustrates a typical blank structure 40 for the tray component of the present invention. The blank includes a substantially centrally located rectangular bottom panel 41 having sidewalls 42,44 connected to two opposed edges thereof along score lines 43,45 and end walls 46,48 connected to the remaining opposed edges along score lines 47,49. The side walls 42,44 and end walls 46,48 are foldably attached to one another at each corner by gusset panels to provide a leakproof structure. For instance, end wall 46 is connected to side wall 42 by way of gusset panels 54,55 which are themselves connected to one another along a diagonal score line 56. Similarly, walls 42 and 48 are connected together by gusset panels 57,58 which are connected to one another along diagonal score 59. This same sequence holds true at the remaining corners where gusset panels 60,61 are connected to one another along diagonal score 62, and gusset panels 63,64 are connected to one another along diagonal score 65. Meanwhile, each of the end walls 46,48 include the locking flaps 50,52 connected thereto along score lines 51,53 respectively.

Each of the diagonal scores 56,59,62 and 65 begin at the intersection of the main panel scores 43,49,45 and 47. In this manner, the blank 40 constitutes a typical construction for making a web corner tray which produces a substantially leakproof final product with the addition of locking flap extentions 50,52 required for the present invention. The locking flaps 50,52 are preferably full width, i.e., they extend along the entire length of the end walls 46,48 and are sized and shaped to cooperate precisely with the combination glue flaps/locking flaps of the cover component.

Figure 4:
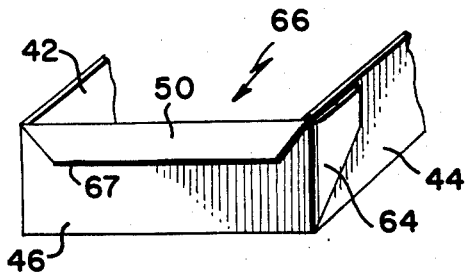
FIG. 4 is a partial perspective view showing one end of the formed tray component.

FIG. 4 illustrates a partial perspective view of the formed tray 66. For this purpose, the gusset panels at each corner are folded in face-to-face contact and then folded around to be adhered to the outside of the side walls 42,44. Each of the side walls 42,44 can then be collapsed along the partial score lines provided therein when it is desired to collapse the tray component 66 for shipment and storage. Moreover, as shown in FIG. 4, when the tray component is squared ready for use, the locking flap 50 is folded downwardly about the score line 51 which forms the top of the tray to make the locking surface 67 thereof readily available for engagement with the locking surfaces 25,26,27 and 28 of the cover component.

Figure 5:
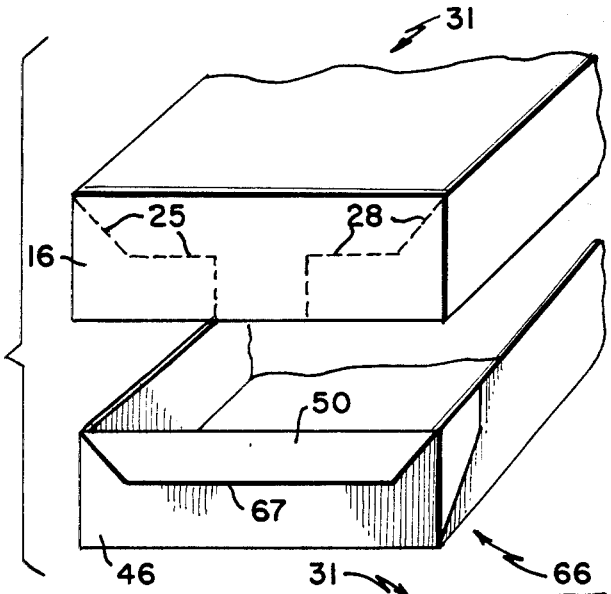
FIG. 5 is an expanded view showing the two components prior to being telescoped one within the other.
Figure 6:
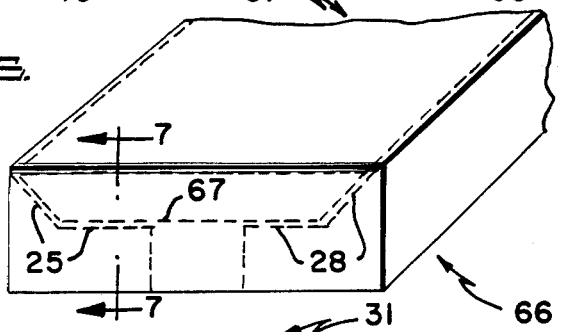
FIG. 6 is a partial perspective view showing one end of the container with the two components fully telescoped and locked together.
Figure 7:
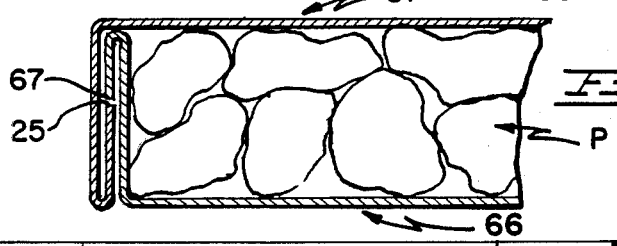
FIG. 7 is a partial sectional view taken along lines 7—7 in FIG. 6.

The container of the present invention is closed as shown in FIG. 5. With both cover component 31 and tray component 66 squared for use, they are aligned in preparation for telescoping one within the other. As the cover 31 moves downwardly over tray 66 as shown in FIG. 6, the locking flap 50 is displaced inwardly toward the attached flap end wall 46 and when fully telescoped, the locking surfaces 25 and 28 of combination glue flaps/locking flaps 20,23 become engaged with the locking surface 67 on flap 50. At this point, the two components 31,66 become effectively permanently locked together. FIG. 7 illustrates in cross section the relationship between the locking surfaces 25,67 of a container filled with product P. Note that the locking flap surface 67 is in direct abutting relation to the locking surface 25 of the combination glue flap/locking flap.

Figure 8:
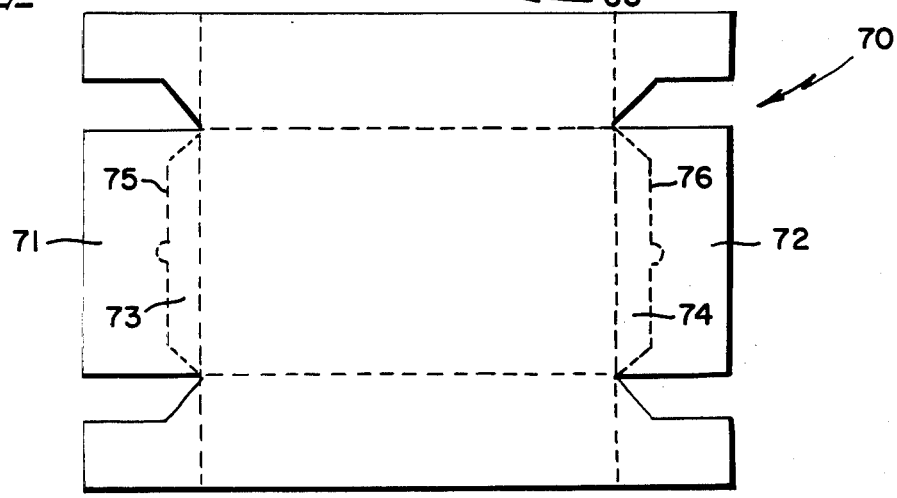
FIG. 8 is a plan view showing a modified blank for constructing the lid component of the invention.
Figure 9:
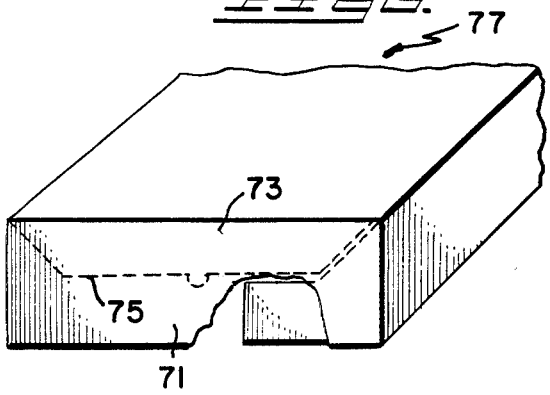
FIG. 9 is a partial perspective view with a section cut away showing one end of the cover component prepared from the blank of FIG. 8.
Figure 10:
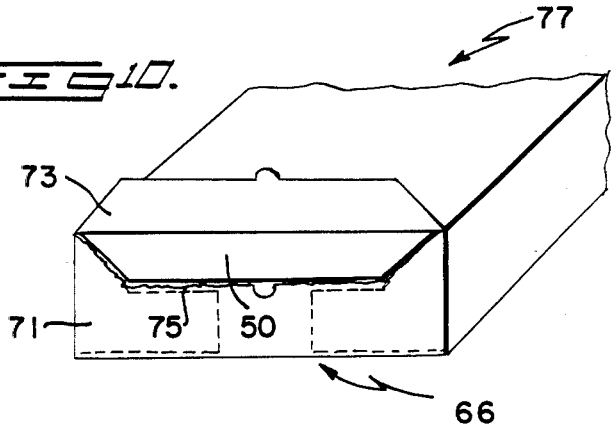
FIG. 10 is a partial perspective view showing one end of the two components fully telescoped with a cover component as shown in FIG. 9.

FIG. 8 illustrates a modified blank structure for the cover component wherein the end walls 71,72 are provided with removable tabs 73,74 formed by perforated lines 75,76 in the general shape of the locking flaps of the tray component. When a cover component 77 is prepared from the blank 70 as shown in FIG. 9, the cover may then be telescoped over a tray component 66 for closing the container. When it is desired to open such a container, the tab element 73 is ripped from end wall 71 along the perforated line 75 to expose the locking flap 50. When so exposed, the locking flap 50 can be forced out of locking position in order to open the container as shown in FIG. 10.

Figure 11:
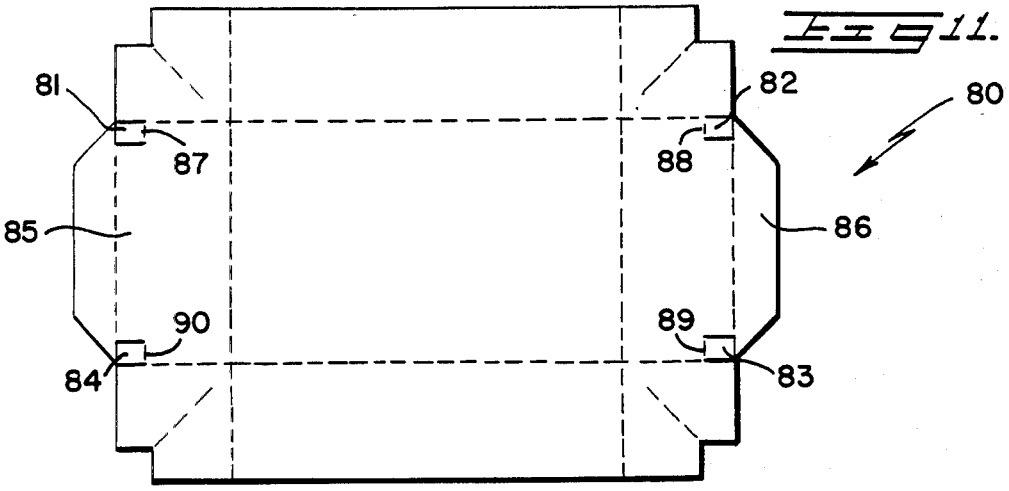
FIG. 11 is a plan view of a tray blank showing a further modification of the present invention; and, FIG. 12 is a partial perspective view showing one end of the tray prepared from the blank of FIG. 11.
Figure 12:
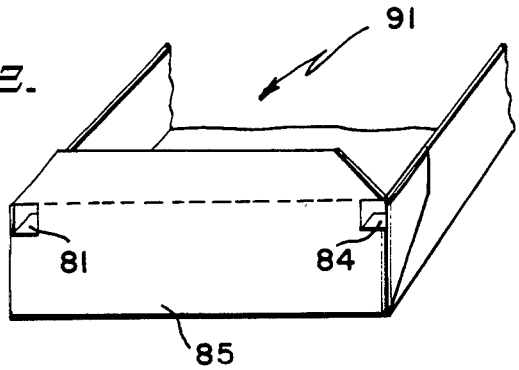

FIG. 11 illustrates a modification for the blank structure used to make the tray component. In this instance the blank 80 is provided with individual tab elements 81,82,83 and 84 at each corner of the end walls 85,86. These tabs are formed by parallel cut lines extending to the edge of end walls 85,86 and they remain attached to the end walls along fold lines 87, 88,89,90. Where a tray 91 is formed from a blank as shown in FIG. 11, the tab elements may be used to retain the side walls of the tray in an upright and open condition for convenience in filling the tray. FIG. 12 shows the tabs 81 and 84 folded inwardly of the tray end wall 85 whereby they may be effective in keeping the side walls upright.

It should be understood that the particular embodiments and features of the present invention disclosed herein are not intended to be restrictive but are for example only. Accordingly, the present invention is intended to cover all modifications that may be obvious to one skilled in the art and which come within the scope of the appended claims.

I claim:

1. A self locking container formed from two telescoping components of generally rectangular shape comprising;

(a) a tray component including a bottom wall, opposed pairs of side walls and opposed pairs of end walls, said walls being upstanding from the bottom wall and connected together by gusset panels at each corner to form a leakproof construction;

(b) at least one pair of lcoking flaps foldably attached to the upper edges of the opposed end walls, said locking flaps having a length substantially equal to the length of the attached end walls and a height that is less than the height of the attached end walls, said locking flaps having locking surfaces on the free edges thereof which are folded outwardly of said tray component;

(c) locking tabs formed in the upper edges of each end wall at each corner of the tray beneath the ends of said locking flaps, said locking tabs comprising tab elements which are formed by paired, spaced apart and parallel cut lines, one of each pair being located at each respective corner of the tray, which extend from cut lines at the upper edge of each end wall located along the fold lines between the end walls and the locking flaps to score lines located within the upper end of each end wall, said tab elements being folded inwardly of the end walls about said score lines to engage the side walls of the tray and retain said side walls and end walls in an upright condition for filling;

(d) a cover component including a top wall, opposed pairs of side walls and opposed pairs of end walls, said walls extending downwardly from said top wall and connected together at each corner by corner flaps foldably attached to the side walls and bonded to the inside of said end walls;

(e) said corner flaps comprising combination glue flaps/locking flaps each of which has a cut away area at the top thereof to form locking surfaces that are equal in distance from the top of the cover component to the height of the locking flaps on the tray component so that the locking surfaces of the tray component abut the locking surfaces of the cover componenet when the two components are fully telescoped one within the other, said cover component further containing removable tab elements in the upper edges of each end wall adjacent to the point where the end walls are connected to the top wall for permitting access to and release of the locking surfaces of the locking flaps of the tray and cover components, said removable tab elements being defined by perforated lines in the end walls of the cover component having the same general shape as the locking flaps of the tray component.

* * * * *